US009020402B2

(12) United States Patent
Wegman

(10) Patent No.: US 9,020,402 B2
(45) Date of Patent: Apr. 28, 2015

(54) METHOD AND APPARATUS FOR REDUCING RESIDUAL TONER IN A ROTATING CONTAINER

(71) Applicant: Xerox Corporation, Norwalk, CT (US)

(72) Inventor: Paul M. Wegman, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 23 days.

(21) Appl. No.: 13/797,879

(22) Filed: Mar. 12, 2013

(65) Prior Publication Data

US 2014/0270856 A1 Sep. 18, 2014

(51) Int. Cl.
*G03G 15/08* (2006.01)

(52) U.S. Cl.
CPC ..... *G03G 15/0867* (2013.01)

(58) Field of Classification Search
CPC ..... G03G 15/0836; G03G 15/0867
USPC ..... 399/106, 107, 254, 261, 258, 262; 222/DIG. 1
See application file for complete search history.

(56) References Cited

U.S. PATENT DOCUMENTS

| | | | | |
|---|---|---|---|---|
| 4,739,907 | A | 4/1988 | Gallant | |
| 4,943,830 | A | 7/1990 | Sulenski | |
| 5,794,108 | A * | 8/1998 | Yoshizawa et al. | 399/262 |
| 6,289,182 | B1 * | 9/2001 | Umezawa et al. | 399/12 |
| 7,088,930 | B2 | 8/2006 | Mimura | |
| 7,881,642 | B2 | 2/2011 | Walsh et al. | |
| 2003/0081968 | A1 * | 5/2003 | Minagawa | 399/258 |
| 2007/0077100 | A1 * | 4/2007 | Suzuki et al. | 399/262 |

FOREIGN PATENT DOCUMENTS

JP 09311535 A * 12/1997 ..... G03G 15/08

* cited by examiner

*Primary Examiner* — Francis Gray
(74) *Attorney, Agent, or Firm* — Ronald E. Prass, Jr.; Prass LLP

(57) ABSTRACT

An approach is provided for reducing an amount of residual toner remaining in a rotating container. The approach involves causing a rotatable vessel configured to contain a toner to be rotated by way of a drive train. The rotatable vessel includes a body section having a substantially round cross-section, a first end at one axial end of the body section, a second end axially distal the first end, and helical features on an internal surface of the body section configured to transport at least a portion of the toner in an axial direction between the first end and the second end as the rotatable vessel is rotated. The approach also involves causing the drive train to impart a periodic pulse to the rotatable vessel. The periodic pulse causes at least a portion of the toner contained by the rotatable vessel to be agitated.

16 Claims, 5 Drawing Sheets

METHOD AND APPARATUS FOR REDUCING RESIDUAL TONER IN A ROTATING CONTAINER

RELATED APPLICATIONS

This application is related to the following co-pending applications, each of which is hereby incorporated herein by reference in its entirety: U.S. patent application Ser. No. 13/691,693, filed Nov. 30, 2012, entitled "SYSTEMS AND METHODS FOR FACILITATING ADVANCED TONER DISPENSING FROM ROTATING TONER CARTRIDGE COMPONENTS," by Gerardo Leute, U.S. patent application Ser. No. 13/797/,696, filed Mar. 12, 2013, entitled "METHOD AND APPARATUS FOR REDUCING RESIDUAL TONER IN A ROTATING CONTAINER," by Ian Harpur et al., and U.S. patent application Ser. No,. 13/797, 714, filed Mar. 12, 2013, entitled "METHOD ANDAPPARATUS FOR REDUCING RESIDUAL TONER IN A ROTATING CONTAINER," by Paul Wegman.

FIELD OF DISCLOSURE

This disclosure relates to an apparatus, method and system for reducing residual toner in a rotating container useful in printing.

BACKGROUND

Some image forming devices use powdered toner as the marking material for image forming on image receiving substrates. The term "toner" generally refers to a powder used as the marking material in image forming devices such as xerographic image forming devices, laser printers and photocopiers to form printed text and images on image receiving substrates.

Toner is typically packaged in containers of differing sizes, shapes and compositions. The containers may be generically referred to as "toner cartridges." Toner cartridges are often closed containers in which the toner is conveniently packaged for supply to customers and/or end users. Toner cartridges are customer replaceable consumable components that the customers or end-users install as complete replacement units in the image forming devices, which may be opened for access to the toner by an image forming device once the toner cartridge is installed in the image forming device Toner cartridge manufacturers are continually challenged with maximizing toner cartridge life expectancy and reducing waste. As a toner cartridge is used, an image forming device may indicate that a toner cartridge is empty, or a user may determine that a toner cartridge is empty based on print quality. But, residual amounts of usable toner may still remain in the toner cartridge despite a determination that a toner cartridge is empty.

SUMMARY

Therefore, there is a need for an approach to reduce residual toner in a rotating container useful in printing.

According to one embodiment, an apparatus useful in printing comprises a rotatable vessel configured to contain a toner. The rotatable vessel comprises a body section having a substantially round cross-section, a first end at one axial end of the body section, a second end axially distal the first end, and helical features on an internal surface of the body section configured to transport at least a portion of the toner in an axial direction between the first end and the second end as the rotatable vessel is rotated. The apparatus also comprises a drive train configured to cause the rotatable vessel to rotate, the drive train further being configured to impart a periodic pulse to the rotatable vessel, the periodic pulse causing, at least in part, at least a portion of the toner contained by the rotatable vessel to be agitated.

According to another embodiment, a method useful in printing comprises causing, at least in part, a rotatable vessel configured to contain a toner to be rotated by way of a drive train. The rotatable vessel comprises a body section having a substantially round cross-section, a first end at one axial end of the body section, a second end axially distal the first end, and helical features on an internal surface of the body section configured to transport at least a portion of the toner in an axial direction between the first end and the second end as the rotatable vessel is rotated. The method also comprises causing, at least in part, the drive train to impart a periodic pulse to the rotatable vessel, the periodic pulse causing, at least in part, at least a portion of the toner contained by the rotatable vessel to be agitated.

According to another embodiment, an image forming device comprises an image marking device and at least one rotating toner delivery container receiving portion. The at least one rotating toner delivery container receiving portion being configured to accommodate a toner delivery container that comprises rotatable vessel configured to contain a toner. The rotatable vessel comprises a body section having a substantially round cross-section, a first end at one axial end of the body section, a second end axially distal the first end, and helical features on an internal surface of the body section configured to transport at least a portion of the toner in an axial direction between the first end and the second end as the rotatable vessel is rotated. The image forming device also comprises a drive train communication port configured to cause a drive train to cause the rotatable vessel to rotate, the drive train further being configured to impart a periodic pulse to the rotatable vessel, the periodic pulse causing, at least in part, at least a portion of the toner contained by the rotatable vessel to be agitated.

Exemplary embodiments are described herein. It is envisioned, however, that any system that incorporates features of any apparatus, method and/or system described herein are encompassed by the scope and spirit of the exemplary embodiments.

BRIEF DESCRIPTION OF THE DRAWINGS

The embodiments are illustrated by way of example, and not by way of limitation, in the figures of the accompanying drawings.

DETAILED DESCRIPTION

Examples of a method, apparatus, and system for reducing residual toner in a rotating container useful in printing are disclosed. In the following description, for the purposes of explanation, numerous specific details are set forth in order to provide a thorough understanding of the embodiments. It is apparent, however, to one skilled in the art that the embodiments may be practiced without these specific details or with an equivalent arrangement. In other instances, well-known structures and devices are shown in block diagram form in order to avoid unnecessarily obscuring the embodiments.

The systems and methods for reducing residual toner in a rotating container according to this disclosure will generally refer to this specific utility for those systems and methods. Exemplary embodiments described and depicted in this disclosure should not be interpreted as being specifically limited to any particular configuration of a rotating toner bottle, cartridge or dispenser, including a plastic or injection molded bottle, cartridge or dispenser. It should be recognized that advantageous use of a unique container configuration that may aid in, in use, emptying of a powdered substance from that container employing devices and methods such as those discussed in detail in this disclosure is contemplated.

As used herein, the term "toner" generally refers to a powdered material used as the marking material in image forming devices such as xerographic image forming devices, laser printers and photocopiers to form printed text and images on image receiving substrates.

As used herein, the term "toner cartridge" generally refers to a closed container in which toner is conveniently packaged for supply to customers and/or end users. Toner cartridges are customer replaceable consumable components that the customers or end-users install as complete replacement units in the image forming devices, which may be opened for access to the toner by an image forming device once the toner cartridge is installed in the image forming device.

As used herein, the term "pulse" may generally refer to any momentary vibration, acceleration, or deceleration, in a rotational or other direction, having the effects of a vibration or force in any direction being exerted on the toner in a rotating container.

As used herein, the term "periodic" may refer to any pulse that may occur at any fixed, random, apparently random, non-regular intervals, or any combination thereof.

Figure 1:
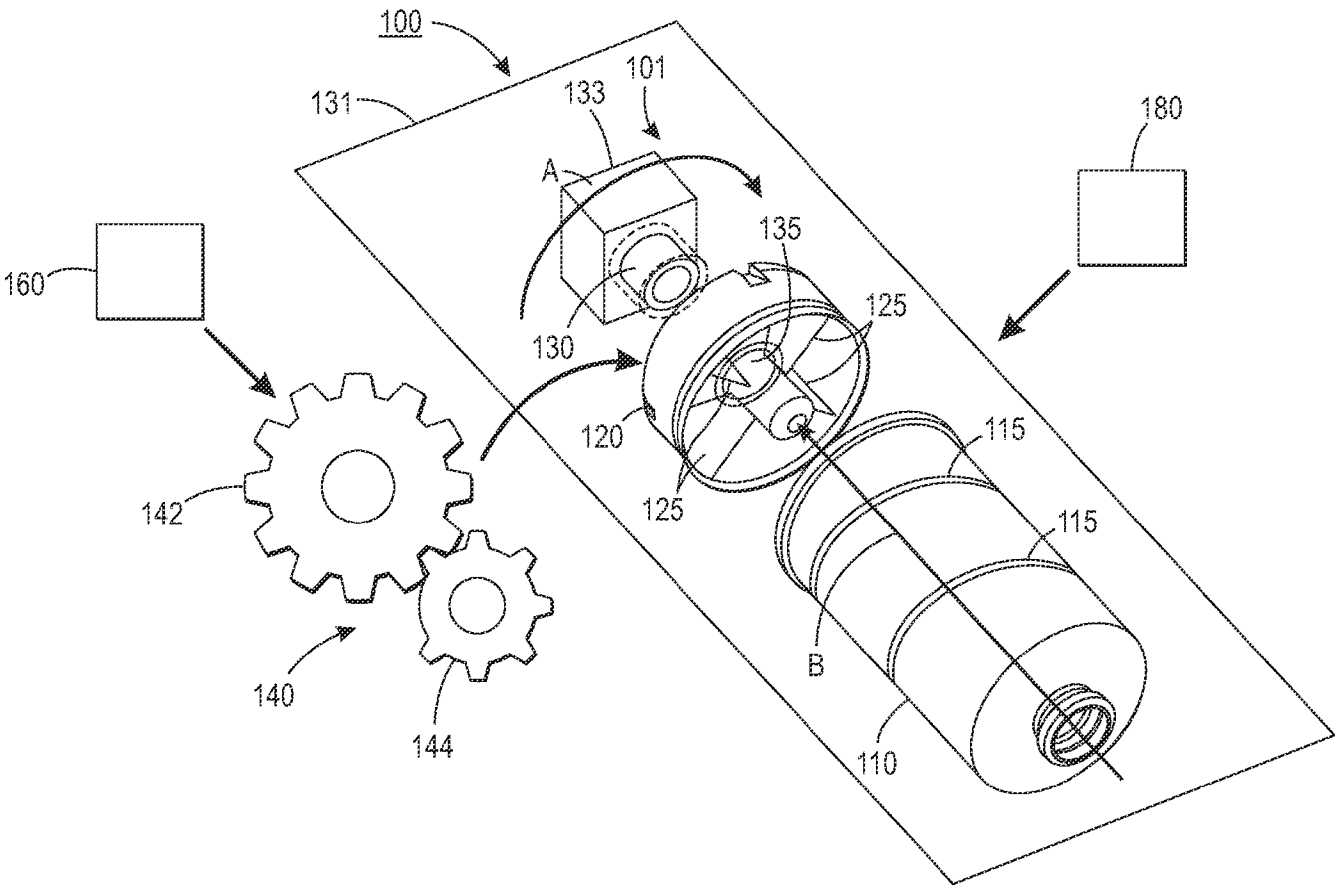
FIG. 1 is an exploded view of a system capable of reducing residual toner in a rotating container, according to one example embodiment.

FIG. 1 is a diagram of a system capable of reducing residual toner in a rotating container, according to one embodiment.

Certain image forming devices use powdered toner as the marking material for image forming on image receiving substrates. Toner is typically packaged in containers of differing sizes, shapes and compositions. These containers often include injection or blow molded container products. The containers may be generically referred to as "toner cartridges." Customers and/or end users need never interact directly with the toner itself.

Image forming devices today include monitoring capabilities for monitoring levels of all consumables, including toner. Upon an indication that any consumable, including toner in a particular toner cartridge, is nearly exhausted, the prudent customer or end-user will procure a replacement consumable component, in this case a toner cartridge, to have it at the ready. In this manner, when the image forming device advises the customer or end-user that the toner is exhausted, the customer or end user need only remove the exhausted component and replace it with a fresh, full component.

One particular configuration of toner cartridges are toner bottles that are generally circular in cross-sectional profile. These toner bottles are particularly configured to be rotated in the image forming device in which they are installed in a manner that causes the toner material contained in the toner bottles to be transported axially toward an opening at dispensing end of the toner bottles. The toner material in the toner bottle is then driven by an internal auger formed from internal helical features toward an axially central opening in the dispensing end, through which the toner material is transported out of the toner bottle to the image forming device for use.

Dispensing all of the toner material from a toner bottle can be challenging. Some percentage of the toner material typically adheres to all of the internal surfaces of the toner bottle, as the material is made to flow axially along the walls of the toner bottle to a dispensing end (endcap) of the toner bottle, and then from the wall of the toner bottle in the endcap radially to a centrally-located dispense point.

It is actually an observed problem in these types of toner bottles that the toner material, in having to slide across the inside surface of the toner bottle to be transported to the discharge end of the toner bottle, may do so inefficiently. When less than all of the toner material slides across the inside surfaces of the bottle, less than all of the toner material will be available to be dispensed from the toner bottle. This results in the toner material remaining in the toner bottle when the toner bottle is seemingly empty, resulting in waste.

Experience has shown that an image forming device may indicate that all of the toner material in a particular toner bottle has been exhausted when some significant amount of usable residual toner material remains in the particular toner bottle. Simple visual inspection of the toner bottle by a customer or end-user during the process of removal and replacement may confirm that a reasonable amount of residual toner remains in the particular toner bottle. Simple manual agitation of the particular toner bottle may result in, for example, dislodging the residual toner adhering to all of the internal surfaces of the particular toner bottle to make the residual toner available for use. Manual agitation may be done, for example, by a user removing the toner bottle from the image forming device, holding and then physically shaking the toner bottle. If the apparently exhausted toner bottle is then reinserted in the image forming device, the residual toner material may be recovered and used by the image forming device.

In view of the above situation in conventional rotating toner bottle image forming devices, it would be advantageous to implement systems and methods by which to dislodge residual toner in the toner bottle so as to maximize toner cartridge life expectancy and thereby reduce both time and materials required for replacing an empty toner cartridge without the need to remove the toner bottle from the image forming device to perform manual agitation.

To address this problem, a system 100 of FIG. 1 introduces the capability to reduce residual toner in a rotating container. FIG. 1 illustrates an exploded view of the system 100 which may be used to supply a powdered material such as a toner to an image forming device. The system 100 generally comprises a toner bottle system 101 and a drive train 140 configured to rotate the toner bottle system 101 and impart a periodic pulse onto the toner bottle system 101. As shown in FIG. 1, the toner bottle system 101 generally includes a container body 110 and an endcap 120. As will be described in greater detail below, the container body 110 and the endcap 120, which are typically combined as a closed vessel, each include physical features that promote flow of toner contained in the toner bottle system 101 to a dispense end that includes a dispensing opening 135, through the endcap 120.

The particular physical features are shown in exemplary manner in the depiction in FIG. 1. The container body 110 may include helical features 115 molded into the wall of the container body 110. The helical features 115 are intended to act as an auger to move or push the toner in the toner bottle system 101 in the axial direction "B" toward the dispense end, i.e., the endcap 120 and dispensing opening 135, as the toner bottle system 101 is rotated in direction "A."

When the toner arrives at the endcap 120 at the dispense end of the toner bottle system 101, there are a plurality of surfaces 125 in the endcap 120 of the toner bottle system 101. This plurality of surfaces 125, again as the toner bottle system 101 is rotated in direction "A," may be used to lift the toner and allow the toner to slide toward the centrally located dispensing opening 135. Once the toner is in the dispensing opening 135, the toner is fed into an image forming material transport conduit 130 of the image forming device in which the toner bottle system 101 is installed. The image forming material transport conduit 130 may be, for example, a part of an image marking device of the image forming device, or at least part of a transportation system for getting toner to the image marking device of the image forming device.

But, as discussed above, some residual toner may remain among the helical features 115 and any surfaces inside the container body 110. Accordingly, the system 100 also includes the drive train 140 configured to rotate the toner bottle system 101 and impart a periodic pulse on the toner bottle system 101. The periodic pulse causes, at least in part, at least a portion of the toner contained by the toner bottle system 101 to be agitated. Agitating at least a portion of the toner contained by the toner bottle system may loosen any toner material that has been compacted or otherwise attached to the helical features 115 and/or internal surface of the container body 110. As such, agitating the toner in the toner bottle system 101 enables a smooth dispensing of the toner inside the toner bottle system 101 almost until the volume of toner inside the toner bottle system 101 reaches 0.

In some embodiments, the drive train 140 is configured to impart the periodic pulse while the rotatable vessel rotates. In other embodiments, the drive train 140 is configured to impart the periodic pulse at a predetermined time such as, but not limited to, a run time of the image forming device, a time between rotations of the toner bottle system 101, or a time corresponding to an estimated amount of toner remaining in the toner bottle system 101.

According to various embodiments, the periodic pulse imparted on the toner bottle system 101 by the drive train 140 causes the toner bottle system 101 to vibrate at any predetermined frequency and amplitude. To impart the periodic pulse, the drive train 140 may include at least two gears such as gear 142 and misaligned gear 144 that are misaligned to an extent that causes the periodic pulse. The misalignment may be caused, for example, by any combination of a missing gear tooth, a difference in shape of one or more gear teeth, a situation in which the two gears are configured in a manner that would otherwise only enable their respective gear teeth to mate on predetermined occasions, etc.

In other embodiments, the predetermined pulse may be alternatively or additionally caused by a vibration inducing device 160 configured to vibrate the drive train 140 and cause the drive train 140 to impart the periodic pulse onto the toner bottle system 101. According to some other embodiments, the periodic pulse may be alternatively or additionally caused by a variation in any bearings associated with the drive train 140 from bearings that would normally enable a smooth operation of the drive train 140.

In some embodiments, the image forming device within which the toner bottle system 101 is installed may be configured to include the drive train 140, or at least part of the drive train 140. In other embodiments, the toner bottle system 101 may be configured to include the drive train 140, or at least a part of the drive train 140.

The image forming device includes at least one rotating toner delivery container receiving portion 131 such as a housing or portion of the image forming device in which the toner bottle system 101 is installed or connected. The image forming device may also include a drive train communication port 133 that is configured to cause the drive train 140, regardless of whether it is a part of the image forming device, the toner bottle system 101, or any combination thereof, to cause the toner bottle system 101 to rotate and impart the periodic pulse onto the toner bottle system 101 to agitate the toner contained by the toner bottle system 101.

According to various embodiments, the system 100 may further comprise a control module 180 that is itself a processor and a memory or embodied to communicate with at least one processor and at least one memory including computer program code for one or more programs, the at least one memory and the computer program code configured to, with the at least one processor, cause the drive train 140 to smoothly operate and impart a periodic pulse on the toner bottle system 101 any of continually, at a predetermined time, or on demand.

For example, the toner bottle system 101 may rotate until a predetermined amount of toner remains in the toner bottle system 101 based, for example, on determined number of images produced by the image forming device, or on a determined amount of toner expelled from the toner bottle system 101. Once that predetermined amount of toner remains in the toner bottle system 101, a predetermined threshold value may be determined to have been met. If the control module 180 determines that the predetermined threshold of amount of remaining toner has been reached, then the control module 180 may cause the drive train to impart a periodic pulse onto the toner bottle system 101 to agitate any residual toner that may remain in the toner bottle system 101.

Figure 2:
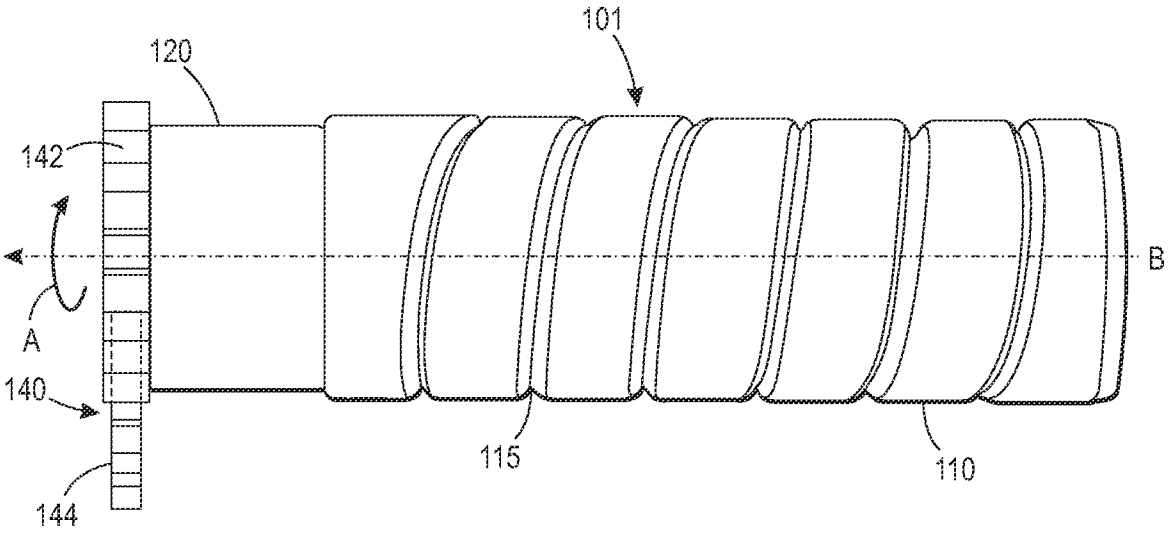
FIG. 2 is a side view of a system capable of reducing residual toner in a rotating container, according to one example embodiment.

FIG. 2 is a side view of a system capable of reducing residual toner in a rotating container, according to one example embodiment. In this example, the toner bottle system 101 includes the container body 110, the helical features 115 formed on an inner surface of the container body 110, and the endcap 120. The drive train 140 is illustrated as being engaged with the toner bottle system 101 and capable of rotating the toner bottle system 101 in the direction "A." The drive train 140, as discussed above, may be part of any combination of the toner bottle system 101 and the image forming device in which the toner bottle system 101 is installed. The drive train 140 is configured to impart a periodic pulse, for example, in a direction opposite the direction "B," or any other direction in which the drive train 140 may transmit a vibration.

The periodic pulse imparted on the toner bottle system 101 by the drive train 140, as discussed above, agitates any toner that is inside the toner bottle system 101 to encourage the toner to collect in a bottle portion of the container body 110 of the toner bottle system 101 to reduce any residual toner that may otherwise remain inside the toner bottle system 101. The periodic pulse may also facilitate a more predictable and even dispensing of the toner within the toner bottle system 101 into the image forming device as the overall volume of toner inside the toner bottle system 101 decreases over time.

Figure 3A:
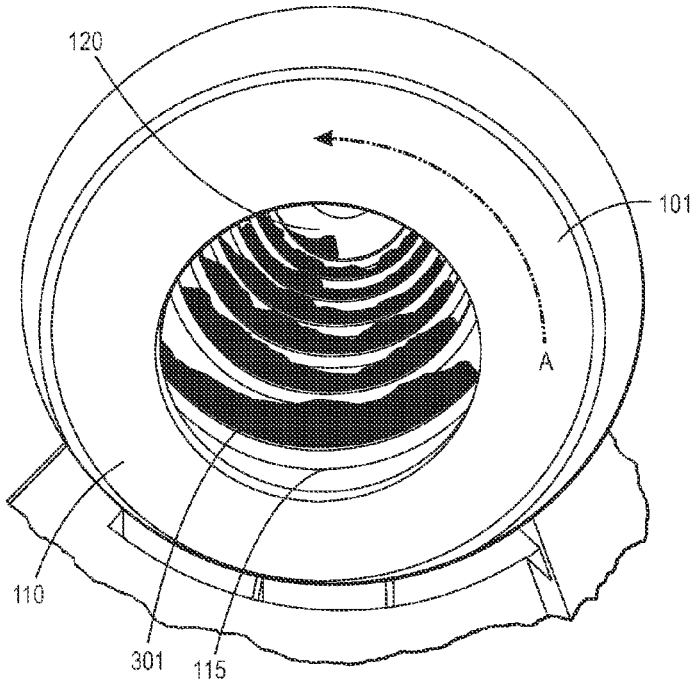
FIG. 3*a* is a diagram illustrating the effects of not agitating any toner contained in a system capable of reducing residual toner in a rotating container, according to one example embodiment.
Figure 3B:
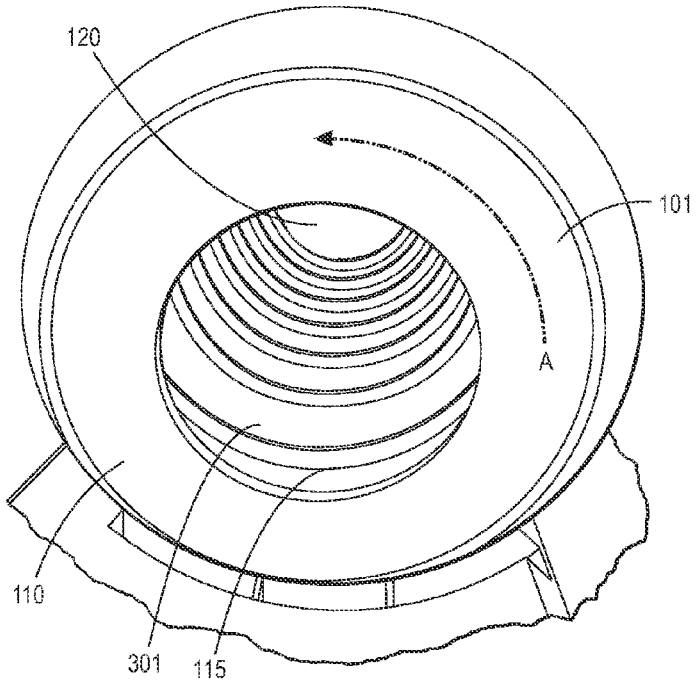
FIG. 3*b* is a diagram illustrating the effects of agitating at least a portion of toner in a system capable of reducing residual toner in a rotating container, according to one example embodiment.

FIGS. 3*a* and 3*b* illustrate the effects agitating toner with a periodic pulse has on reducing residual toner in a rotating container.

FIG. 3*a* illustrates a perspective view from an end portion of the container body 110 facing the direction "B," discussed above, toward the endcap 120. In this example, toner bottle system 101 has not been subjected to the periodic pulse, discussed above. Accordingly, while the toner 301 is driven toward the dispensing end of the toner bottle system 101, some residual toner 301 remains attached to the helical features 115 and any inner surfaces of the container body 110 within channels formed by the helical features 115 and the inner surface of the container body 110.

FIG. 3*b* illustrates a perspective view from the same end portion of the container body 110 facing the direction "B" toward the endcap 120 as shown in FIG. 3*a*. In this example, however, the toner bottle system 101 was subjected to the periodic pulse discussed above. As such, the periodic pulse imparted by the drive train 140 causes the residual toner 301 to be agitated such that the residual toner 301 separates from the helical features 115 and the inner surfaces of the container body 110 so that the residual toner 301 can be driven by the helical features 115 toward the endcap 120 for dispensing into the image forming device.

According to this example, if the periodic pulse was not imparted on the toner bottle system 101 to agitate the toner 301, approximately 125 grams of residual toner 301 would have been wasted, which is equivalent to approximately 3000 printed sheets of a substrate. But, because the toner bottle system 101 was subjected to the periodic pulse, and the toner 301 was agitated, a majority of the residual toner 301, if not all of the residual toner 301, is able to be recovered by the system 100 thereby maximizing the life expectancy of the toner bottle system 101 and reducing waste. It should be noted, however, that this reduction in residual toner 301 and waste is merely an example to illustrate the effectiveness of agitating toner by way of the periodic pulse imparted on the toner bottle system 101 and the system 100 as a whole. The performance of the system 100 should not be considered to be limited to the above-discussed quantities relating to residual toner recovery and waste reduction performance.

Figure 4A:
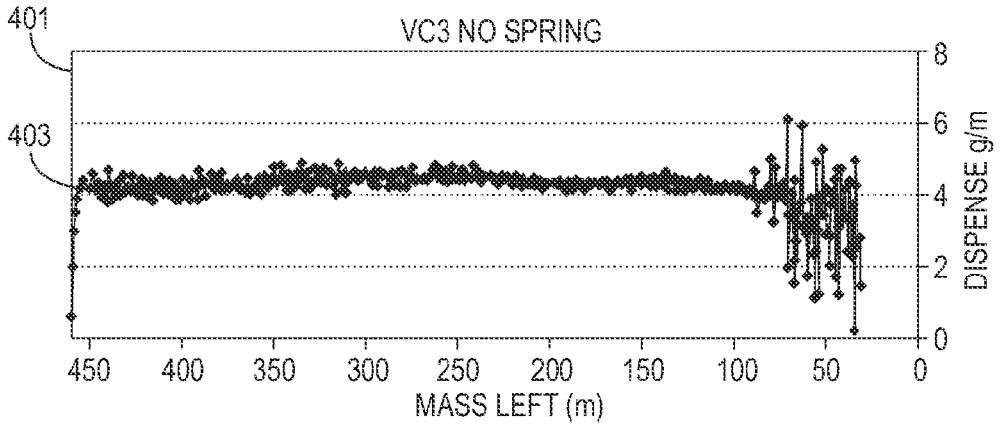
FIG. 4*a* is a chart illustrating a rate at which toner is dispensed by a rotating container without agitating the toner, according to one example embodiment.
Figure 4B:
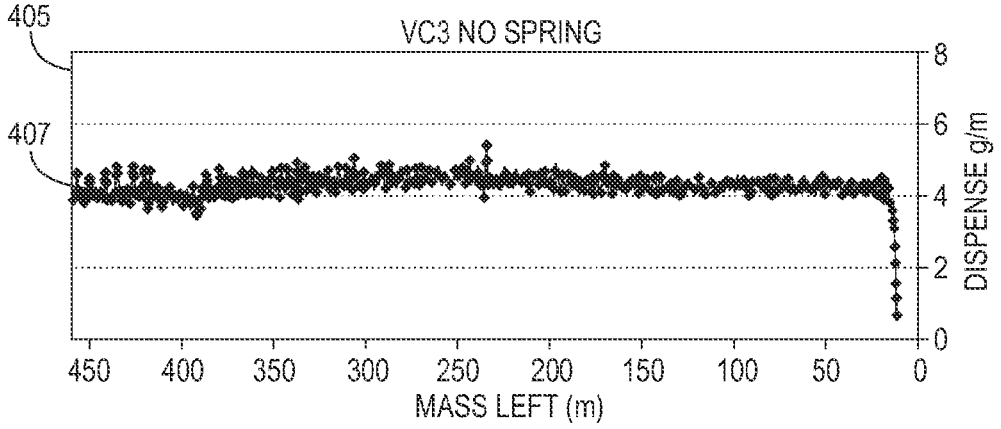
FIG. 4*b* is a chart illustrating the effect agitating at least a portion of the toner has on reducing residual toner in a rotating container, according to one example embodiment.

FIGS. 4*a* and 4*b* are charts illustrating the effect agitating residual toner with a periodic pulse has on reducing residual toner in a rotating container. FIGS. 4*a* and 4*b* are test cases in which toner is fed from a toner bottle system, such as that discussed above. The test cases measured the amount of toner in grams that was dispensed by the toner bottle system as the mass of the toner remaining in the toner bottle system decreased.

FIG. 4*a* illustrates an example test case 401 in which the toner in the toner bottle system is not agitated by a periodic pulse. In this example, the amount of toner dispensed by the toner bottle system as the remaining mass of toner inside the toner bottle system decreases is illustrated by plot 403. Plot 403 shows that as the mass of toner in the system decreases from about 450 grams to about 100 grams, the amount of toner that is dispensed by the toner bottle system is relatively consistent and is about 4 grams. But, after the toner bottle system has less than about 100 grams remaining, then the amount of toner dispensed by the toner bottle system becomes randomized which illustrates that the performance of the toner bottle system is not optimal and the image forming device may determine that the toner bottle system is "empty." Print quality of the image forming device may also be noticeably reduced even though the toner bottle system still has a usable amount of toner available inside it.

FIG. 4*b* illustrates an example test case 405 in which the toner in the toner bottle system is agitated by a periodic pulse imparted on a toner bottle system by a drive train, as discussed above In this example, the amount of toner dispensed by the toner bottle system as the remaining mass of toner inside the toner bottle system decreases is illustrated by plot 407. Plot 407 shows that as the mass of toner in the system decreases from about 450 g to about 10 grams, the amount of toner that is dispensed by the toner bottle system is relatively consistent and is about 4 grams. But, after the toner bottle system has less than about 10 grams remaining, then the amount of toner dispensed by the toner bottle system significantly drops toward 0 grams. This test illustrates that the performance of the toner bottle system is optimal almost until the toner bottle system is entirely empty. Accordingly, a lesser amount of, if any, residual toner remains in the toner bottle system as compared to a toner bottle system in which the toner inside the toner bottle system is not agitated. If the toner bottle system is agitated by a periodic pulse, such as that discussed above, life expectancy of the toner bottle system that agitates its toner is longer than a toner bottle system that does not. As such, the image forming device may not determine that the toner bottle system is "empty" and/or print quality of the image forming device may not be noticeably reduced until the toner bottle system has close to 0 grams of residual toner remaining inside it.

Figure 5:
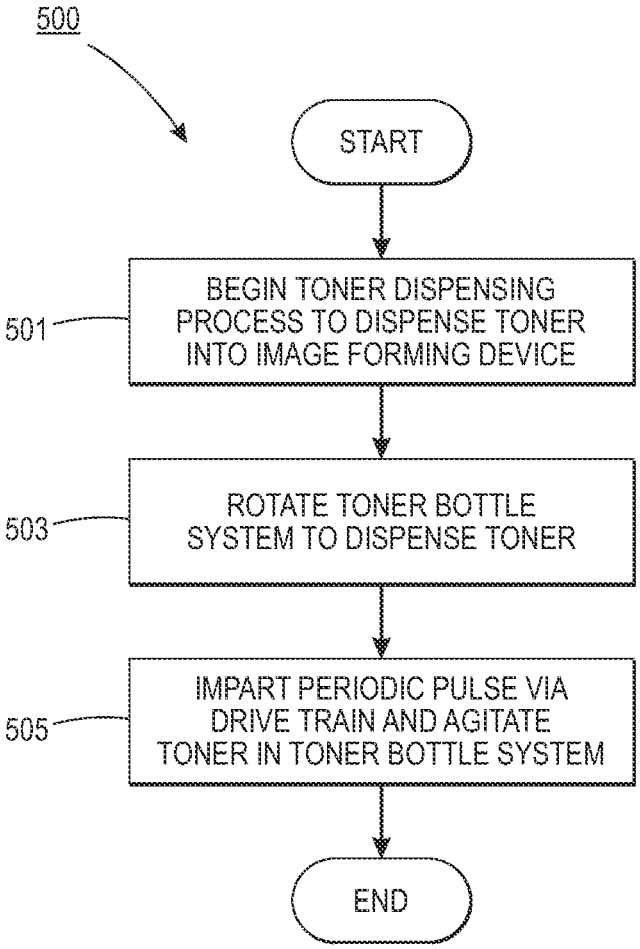
FIG. 5 is a flowchart of a process for reducing residual toner in a rotating container, according to one embodiment.

FIG. 5 is a flowchart of a process 500 for reducing residual toner in a rotating container, according to one embodiment. In step 501, an instruction to begin a toner dispensing process to dispense toner into an image forming device from a rotatable toner bottle system is provided. Then, in step 503, the toner bottle system is caused to rotate by a drive train to dispense toner that is contained by the toner bottle system. The toner bottle system, in this example, includes a container body, an endcap, and helical features formed on an internal surface of at least the container body to move toner toward a dispense end of the toner bottle system. Next, in step 505, the drive train is caused to impart a periodic pulse onto the toner bottle container so as to agitate at least a portion of the toner inside the toner bottle system. The agitation minimizes or eliminates any residual toner that would normally be left attached to any helical features or internal surface of the container body after a majority of the toner inside the toner bottle system is transported by the helical features to a dispensing end of the toner bottle system and into an image forming device.

The processes described herein for reducing residual toner in a rotating container may be advantageously implemented via software, hardware, firmware or a combination of software and/or firmware and/or hardware. For example, the processes described herein, may be advantageously implemented via processor(s), a Digital Signal Processing (DSP) chip, an Application Specific Integrated Circuit (ASIC), Field Programmable Gate Arrays (FPGAs), etc.

The disclosed embodiments may include a non-transitory computer-readable medium storing instructions which, when executed by a processor, may cause the processor to execute all, or at least some, of the steps of the method outlined above.

The above-described exemplary systems and methods reference certain conventional components to provide a brief, general description of suitable operating and product processing environments in which the subject matter of this disclosure may be implemented for familiarity and ease of understanding. Physical components in this disclosure may be in the form or molded and injection molded structures. Although not required, embodiments of the disclosure may be provided, at least in part, in a form of hardware circuits, firmware, or software computer-executable instructions to carry out the specific functions described. These may include individual program modules executed by a processor.

Those skilled in the art will appreciate that other embodiments of the disclosed subject matter may be practiced in devices, including image forming devices, of many different configurations.

As indicated above, embodiments within the scope of this disclosure may include computer-readable media having stored computer-executable instructions or data structures that can be accessed, read and executed by one or more processors. Such computer-readable media can be any available media that can be accessed by a processor, general purpose or special purpose computer. By way of example, and not limitation, such computer-readable media can include one or more of dynamic memory (e.g., RAM, magnetic disk, writable optical disk, flash card, etc.) and static memory (e.g., ROM, CD-ROM, etc.) for storing executable instructions or data structures that when executed perform the steps described herein to reduce residual toner in a rotating container.

Computer-executable instructions include, for example, non-transitory instructions and data that can be executed and accessed respectively to cause a processor to perform certain of the above-specified functions, individually or in various combinations. Computer-executable instructions may also include program modules that are remotely stored for access and execution by a processor.

The exemplary depicted sequence of executable instructions or associated data structures represents one example of a corresponding sequence of acts for implementing the functions described in the steps of the above-outlined exemplary method. The exemplary depicted steps discussed above may be executed in any reasonable order to effect the objectives of the disclosed embodiments. No particular order to the disclosed steps of the disclosed method is necessarily implied any discussion or depiction, except where a particular method step is a necessary precondition to execution of any other method step.

Although the above description may contain specific details, they should not be construed as limiting the claims in any way. Other configurations of the described embodiments of the disclosed systems and methods are part of the scope of this disclosure.

It will be appreciated that various of the above-disclosed and other features and functions, or alternatives thereof, may be desirably combined into many other different systems or applications. Also, various alternatives, modifications, variations or improvements therein may be subsequently made by those skilled in the art which are also intended to be encompassed by the following claims.

What is claimed is:

1. An apparatus useful in printing comprising:

a rotatable vessel configured to contain a toner, the rotatable vessel comprising a body section having a substantially round cross-section, a first end at one axial end of the body section, a second end axially distal the first end, and helical features on an internal surface of the body section configured to transport at least a portion of the toner in an axial direction between the first end and the second end as the rotatable vessel is rotated in a first direction; and a drive train configured to cause the rotatable vessel to rotate, the drive train further being configured to impart a periodic pulse to the rotatable vessel, the periodic pulse causing a portion of the toner contained by the rotatable vessel to be agitated, wherein the drive train is configured to impart the periodic pulse while the rotatable vessel rotates in the first direction;

a control module to cause the drive train to impart the periodic pulse onto the rotatable vessel in response to a predetermined condition, wherein the predetermined condition is one of a run time of the image forming device, a time between rotation of the rotatable vessel, or an estimated amount of toner remaining in the rotatable vessel;

wherein to impart the periodic pulse, the drive train comprises at least a first gear and a second gear in misalignment;

wherein the misalignment is caused by a difference in shape of one or more gear teeth at the second gear.

2. The apparatus of claim 1, wherein the drive train is configured to impart the periodic pulse at a predetermined time.

3. The apparatus of claim 1, wherein the periodic pulse causes the rotatable vessel to vibrate at a predetermined frequency and amplitude.

4. The apparatus of claim 1, further comprising a vibration inducing device configured to vibrate the drive train and cause the drive train to impart the periodic pulse.

5. A method useful in printing comprising:

causing, at least in part, a rotatable vessel configured to contain a toner to be rotated by way of a drive train, the rotatable vessel comprising a body section having a substantially round cross-section, a first end at one axial end of the body section, a second end axially distal the first end, and helical features on an internal surface of the body section configured to transport at least a portion of the toner in an axial direction between the first end and the second end as the rotatable vessel is rotated; and causing, at least in part, the drive train to impart a periodic pulse to the rotatable vessel, the periodic pulse causing, at least in part, at least a portion of the toner contained by the rotatable vessel to be agitated, wherein the drive train is configured to impart the periodic pulse while the rotatable vessel rotates;

controlling in response to a predetermined condition the drive train to impart the periodic pulse onto the rotatable vessel, wherein the predetermined condition is one of a run time of the image forming device, a time between rotation of the rotatable vessel, or an estimated amount of toner remaining in the rotatable vessel;

wherein to impart the periodic pulse, the drive train may include at least a first gear and a second gear in misalignment;

wherein the misalignment is caused by a difference in shape of one or more gear teeth at the second gear.

6. The method of claim 5, wherein the drive train is configured to impart the periodic pulse at a predetermined time.

7. The method of claim 5, further comprising:

determining a fill level of the rotatable vessel as the rotatable vessel rotates to dispense toner into an image forming device and the fill level decreases; and causing, at least in part, the drive train to impart the periodic pulse on demand based, at least in part, on a predetermined fill level threshold being reached.

8. The method of claim 5, wherein the periodic pulse causes the rotatable vessel to vibrate at a predetermined frequency and amplitude.

9. The method of claim 5, wherein the drive train comprises at least two gears, the at least two gears being misaligned to an extent that causes the periodic pulse.

10. The method of claim 5, further comprising causing, at least in part, a vibration inducing device configured to vibrate the drive train to cause the drive train to impart the periodic pulse.

11. An image forming device comprising:

an image marking device;

at least one rotating toner delivery container receiving portion, the at least one rotating toner delivery container receiving portion being configured to accommodate a toner delivery container comprising rotatable vessel configured to contain a toner, the rotatable vessel comprising a body section having a substantially round cross-section, a first end at one axial end of the body section, a second end axially distal the first end, and helical features on an internal surface of the body section configured to transport at least a portion of the toner in an axial direction between the first end and the second end as the rotatable vessel is rotated; and a drive train communication port configured to cause a drive train to cause the rotatable vessel to rotate, the drive train further being configured to impart a periodic pulse to the rotatable vessel, the periodic pulse causing, at least in part, at least a portion of the toner contained by the rotatable vessel to be agitated, wherein the drive train is configured to impart the periodic pulse while the rotatable vessel rotates;

a vibration inducing device configured to vibrate the drive train and cause the drive train to impart the periodic pulse onto the rotating toner delivery container;

a control module to cause the drive train to impart the periodic pulse onto the rotating toner delivery container in response to a predetermined condition, wherein the predetermined condition is one of a run time of the image forming device, a time between rotation of the rotating toner delivery container, or an estimated amount of toner remaining in the rotating toner delivery container.

12. The image forming device of claim 11, wherein the drive train is configured to impart the periodic pulse at a predetermined time.

13. The image forming device of claim 11, wherein the periodic pulse causes the rotatable vessel to vibrate at a predetermined frequency and amplitude.

14. The image forming device of claim 11, wherein the drive train comprises at least two gears, the at least two gears being misaligned to an extent that causes the periodic pulse.

15. The image forming device of claim 11, wherein the image forming device further comprises the drive train.

16. The image forming device of claim 11, wherein the toner deliver container further comprises the drive train.

* * * * *